United States Patent [19]

Lacchia

[11] 4,185,783

[45] Jan. 29, 1980

[54] POWDER FEED DEVICE FOR POWDER DISPENSING APPARATUS

[75] Inventor: Adrien Lacchia, Meylan, France

[73] Assignee: Air Industrie, Courbevoie, France

[21] Appl. No.: 914,867

[22] Filed: Jun. 12, 1978

[30] Foreign Application Priority Data

Jun. 14, 1977 [FR] France ..... 77 19043

[51] Int. Cl.[2] ..... B05B 5/02

[52] U.S. Cl. ..... 239/704; 361/213; 406/86

[58] Field of Search ..... 239/690–708, 239/3; 302/29, 64; 361/213; 118/621–636; 427/25, 27; 406/86

[56] References Cited

U.S. PATENT DOCUMENTS

| | | | |
|---|---|---|---|
| 3,048,498 | 8/1962 | Juvinall et al. | 239/708 X |
| 3,698,636 | 10/1972 | Szasz | 239/697 |
| 3,740,612 | 6/1973 | Gauthier et al. | 239/706 X |

FOREIGN PATENT DOCUMENTS

| | | | |
|---|---|---|---|
| 1153868 | 5/1969 | United Kingdom | 239/708 |

*Primary Examiner*—Joseph E. Valenza
*Assistant Examiner*—Andres Kashnikow
*Attorney, Agent, or Firm*—Brisebois & Kruger

[57] ABSTRACT

A powder feed device for supplying a powder dispensing apparatus such as a powder spray gun of an electrostatic powder deposition system. Entrained powder is extracted from a fluidization tank and transported through a half-inch diameter tube or hose to the dispensing apparatus. To prevent clumps of powder and/or powder adhering to the walls of the tube or hose while permitting reduced air flow speed of about 2 to 3 m/s an electric field is provided in the tube or hose and applied by an outer conductor extending around the tube or hose and an inner wire conductor inside the tube or hose extending in the direction of the flow of entrained powder, which conductors are connected across an AC voltage source. The electric field may operate constantly or intermittently.

8 Claims, 2 Drawing Figures

A.C. GENERATOR
1
2
3
4
4a
5
6
7
8
8A
9
10
11
12
13
13A
13B
13C
14
15
15A
16
17

POWDER FEED DEVICE FOR POWDER DISPENSING APPARATUS

BACKGROUND OF THE INVENTION

The present invention relates to an improved powder feed device for a powder dispensing apparatus such as a manual or automatic electrostatic powder spray gun.

The present invention relates more particularly to a powder feed device of the type in which the feeding of powder to the powder dispensing apparatus is effected pneumatically through a flexible tube or hose having an internal diameter of the order of 12 millimeters (about a half an inch), for example, by connecting the inlet of the dispensing apparatus to a powder fluidization tank through venturi extracting means.

The pneumatic transportation through such a tube or hose which may be several meters long, generally requires very high air flow rates if concentrations or clumps of the transported powder are to be avoided, by maintaining a relatively homogeneous powder suspension in the entraining air. Such high air flow rates mean air flow speeds greater than 8 m/s which are deleterious to electrostatic spraying as the trajectories of powder particles are unduly influenced by their velocity as opposed to the electrostatic field.

SUMMARY OF THE INVENTION

An object of the present invention is therefore a powder feed device in which the powder flow rate is uniform and free from concentrations or clumps while employing reduced entraining air flow speeds and maintaining the powder in a relatively homogeneous suspension in a feed tube or hose of the aforementioned type.

Another object of the invention is to prevent powder from accumulating along the internal wall of the feed tube or hose.

To achieve these objects the invention utilizes an A.C. electric field in a mass of powder particles which is known per se.

U.S. Pat. No. 3,888,207 (Stutz et al) issued on June 10, 1975, teaches a technique of agitating powder contained in enclosures of various configurations with a view to "shooting" the particles of powder on the article to be coated. This technique utilizes pulsating or alternating voltages established between a plate and a grid. A French patent publication No. 2,281,171 (Masuda) published Mar. 5, 1976, teaches the use of an A.C. electric field screen for the transportation of pulverulent material to a use station.

According to the invention there is provided in an electrostatic powder dispensing system a powder feed device for a powder dispensing apparatus having a powder inlet member and a spray head, a powder fluidization tank, a powder extracting means associated with the fluidization tank for extraction entrained powder therefrom, said powder feed device comprising a powder feed tube or hose connected and adapted to convey entrained powder between the powder extracting means and the inlet of the dispensing apparatus, the improvement comprising said tube or hose being formed of electrically insulating material, an outer conductor extending around said tube or hose along the major part thereof, and an inner conductor extending through said tube or hose substantially in the direction of the flow entrained powder from said powder extracting means to the inlet member of the powder dispensing apparatus, said inner and outer conductors being connected across an A.C. voltage source.

Experience has shown that the A.C. radial field thus formed between the inner conductor and the outer conductor makes it feasible, without being detrimental to the uniformity of powder flow, to considerably reduce the entraining air speed and, therefore, the momentum which tends to interfere with the efficiency of electrostatic deposition of the powder on an article to the coated.

The present invention will be better understood by means of the following description, given by way of example, of an embodiment with reference to the accompanying drawings.

DETAILED DESCRIPTION OF THE PREFERRED EMBODIMENT

Figures 1, 2:
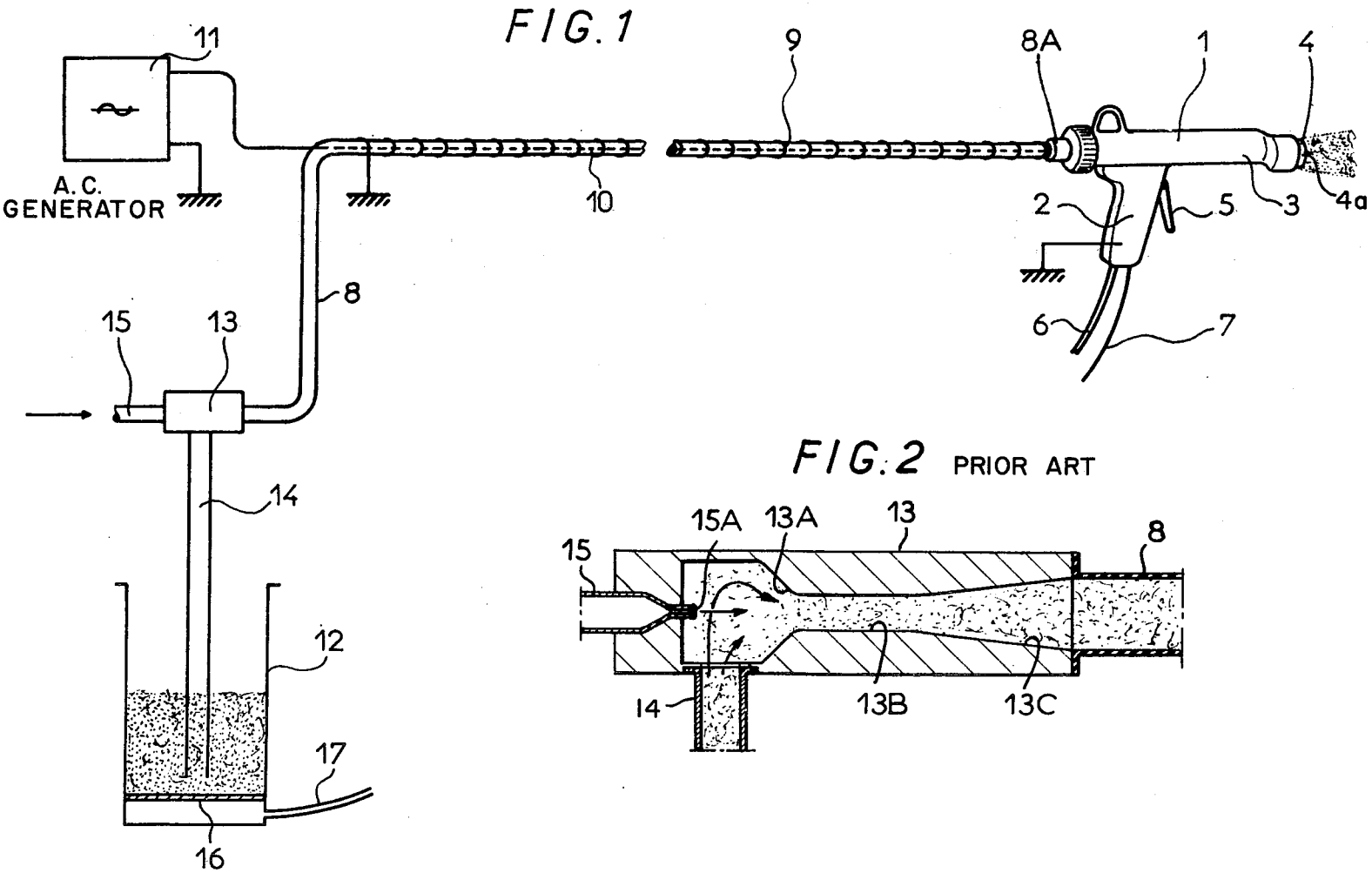
FIG. 2 PRIOR ART
FIG. 1 is a schematic showing of an electrostatic powder dispensing system.
FIG. 2 is a fragmentary sectional view of the powder extracting means of the powder.

In FIG. 1 reference numeral 1 denotes an electrostatic powder spray gun, such as the manual spray gun sold by the assignees of the present invention under the trademark STAJET. Such a spray gun comprises, in a manner known per se, a grounded hand grip 2, an insulating barrel 3, a spray head 4 including a spray nozzle, a charging electrode 4*a*, an operating member or trigger 5, a high voltage supply cable 6 for charging the electrode with a high voltage generator (not shown), a low voltage cable 7 connected to the exciter circuit of the generator, together with a switch (not shown) actuated by the operating member 5 and, last of all, a tubular inlet member 8A connected to a feed tube or hose 8.

The powder feed tube 8 comprises, as conventional, a flexible hose of insulating material several meters long and having an internal diameter of the order of, say, 12 millimeters or a half an inch. According to the invention an outer metal conductor extends around a major part of the feed tube or hose and is connected to the ground of the system; an inner conductor 10 passes through the interior of the tube or hose 8. The outer conductor 9 which comprises, for example, a wire coil or a wire mesh sheath extending around the insulating feed tube 8, and the inner conductor 10 are respectively connected to the terminals of a high voltage A.C. generator 11 producing 10 kilovolts rms. The outer conductor 9 is, of course, connected to the grounded terminal of the generator 11 as well as the ground for the entire system.

In a manner known per se, the powder is extracted from a powder fluidization tank 12 provided with a perforate fluidization plate 16 and a fluidization air supply conduit 17 by means of a classic venturi type powder extractor 13 provided with a siphon tube 14 and an injection air inlet 15.

FIG. 2 illustrates the known construction of a powder extractor 13 which comprises a convergent zone 13A followed by a mixing zone 13B and a diffuser zone 13C which is coupled to the inlet end of the powder feed tube or hose 8. An air injection conduit 15 terminates inside extractor 13 in a tubular end piece 15A of reduced diameter (e.g. 2 mm) adapted to expel along the axis of the convergent zone 13A a main air stream which ensures by the entrainment of the auxiliary air stream from the fluidization tank 12 the pneumatic transportation of powder through the feed tube or hose 8.

The feed tube or hose 8 including its inner and outer conductors 10 and 9 provides a particularly efficient improvement in the uniformity powder feed to the spray gun 1.

The high voltage A.C. generator 11 may operate constantly. It is also possible for it to operate intermittently each time there is an accumulation of powder tending to adhere along the internal wall of the feed tube or hose 8.

The inner wire conductor 10 may be, if desired, held in position substantially along the axis of the feed tube 8 by means of radial supports (not shown) adapted to be arranged at spaced locations inside the feed tube, but this is not mandatory; the inner wire conductor may, on the contrary, extend through the feed tube eccentrically of the axis of the tube provided that, it extends generally along the direction of the flow of powder so as to interfere as little as possible with the flow therethrough.

If the present powder feed device is employed during the operation of an associated powder dispensing apparatus it is possible to reduce the entraining air speed from 8 m/s to 2 to 3 m/s while insuring the homogeneous flow of entrained powder and without attendant the difficulties encountered in using speeds of the order of 8 m/s as discussed above.

What I claim is:

1. A powder feed device adapted to convey fluidized powder between a powder fluidization tank and an inlet of an electrostatic powder dispensing apparatus having an electrostatic spray head and electrode charging means, said powder feed device comprising a powder feed tube formed of electrically insulating material, means for subjecting the powder flowing through said tube to an alternating field for insuring homogenous flow of fluidized powder through the tube and comprising, an outer conductor extending around said tube along the major part thereof, an inner conductor extending through said tube or hose substantially in the direction of flow of fluidized powder to be dispensed, and means for connecting said inner and outer conductors across a high voltage A.C. source, so as to prevent the formation of and/or to break up clumps or concentrations of fluidized powder in said feed tube or hose.

2. In an electrostatic powder deposition system, a powder feed device for an electrostatic powder dispensing apparatus having a powder inlet member, a spray head and electrode charging means, a powder fluidization tank, a powder extracting means associated with the fluidization tank for extracting entrained powder therefrom, said powder feed device comprising a powder feed tube connected between and adapted to convey entrained powder between the powder extracting means and the inlet of the dispensing apparatus, the improvement wherein said tube comprises a tube formed of electrically insulating material, and means for subjecting the powder flowing through said tube to an alternating field for insuring homogenous flow of entrained powder in said tube and comprising an outer conductor extending around said tube along the major part thereof, an inner conductor extending through said tube substantially in the direction of the flow of entrained powder from said powder extracting means to the inlet member of the powder dispensing apparatus, an A.C. voltage source, and means connecting said inner and outer conductors across said A.C. voltage source, whereby said alternating field insures homogenous flow of and prevents the formation of or breaks up clumps or concentrations of powder in said feed tube.

3. The powder feed device according to claim 2, wherein said inner conductor comprises a wire conductor disposed generally parallel to the axis of said tube or hose.

4. The powder feed device according to claim 2, wherein said outer conductor comprises a wire mesh sheath.

5. The powder feed device according to claim 2, 3 or 4, wherein said outer conductor is grounded.

6. The powder feed device according to claim 2, wherein said inner conductor lies substantially along the axis of said tube or hose.

7. The powder feed device according to claim 2, wherein said A.C. voltage source is distinct from a high voltage generator for supplying the electrostatic charging electrode means.

8. The powder feed device of claim 2 wherein, said feed tube comprises a hose.

* * * * *